US012582881B1

(12) United States Patent
Patel et al.

(10) Patent No.: US 12,582,881 B1
(45) Date of Patent: Mar. 24, 2026

(54) PUTTER HEAD WITH REMOVABLE WEIGHTED ARTIFACT

(71) Applicant: Indesign Products, Inc., Boise, ID (US)

(72) Inventors: Shamik Patel, Boise, ID (US); Sungyoung Lim, Yongin-si (KR); Ryan Finke, Boise, ID (US); Sunil Patel, Boise, ID (US); Shiven Patel, Burlington (CA)

(73) Assignee: Indesign Products, Inc., Boise, ID (US)

( * ) Notice: Subject to any disclaimer, the term of this patent is extended or adjusted under 35 U.S.C. 154(b) by 0 days.

(21) Appl. No.: 19/322,626

(22) Filed: Sep. 8, 2025

Related U.S. Application Data

(60) Provisional application No. 63/846,109, filed on Jul. 17, 2025.

(51) Int. Cl.
*A63B 53/04* (2015.01)
*A63B 53/06* (2015.01)
*A63B 53/08* (2015.01)

(52) U.S. Cl.
CPC ..... *A63B 53/08* (2013.01); *A63B 53/0487* (2013.01); *A63B 2053/0491* (2013.01); *A63B 2209/08* (2013.01)

(58) Field of Classification Search
CPC ..... A63B 53/0487; A63B 53/047
USPC ..... 473/340
See application file for complete search history.

(56) References Cited

U.S. PATENT DOCUMENTS 4,519,612 A * 5/1985 Tsao ..... A63B 53/0487 473/250
4,754,976 A * 7/1988 Pelz ..... A63B 53/0487 473/340
4,999,000 A * 3/1991 Finney ..... A63B 53/0487 473/341
5,060,950 A * 10/1991 Finney ..... A63B 53/0487 473/341
5,558,332 A * 9/1996 Cook ..... A63B 53/0487 473/341
5,683,307 A * 11/1997 Rife ..... A63B 53/0487 473/340
5,785,608 A * 7/1998 Collins ..... A63B 53/0487 473/294

(Continued)

FOREIGN PATENT DOCUMENTS

JP 2006198385 A 8/2006
KR 102671179 B1 5/2024

*Primary Examiner* — Alvin A Hunter
(74) *Attorney, Agent, or Firm* — Burdick Patents, P.A.; Sean D. Burdick; Colin L. Honan

(57) ABSTRACT

A customizable putter head has a body defining an impact face formed between top and bottom surfaces. A platform extends from the body perpendicularly to the impact face. Formed in the top surface of the body is a means for engaging a putter shaft. A weighted artifact extends from the platform above the top surface. The weighted artifact is removably and rotatably attached to the platform, allowing a player to customize the aesthetic appearance of the putter head by selecting various styles of weighted artifacts, such as sculptures or models. The player may also customize the weight distribution of the putter head by rotating an attached asymmetrical weighted artifact around the platform relative to the impact face.

18 Claims, 9 Drawing Sheets

(56) References Cited

U.S. PATENT DOCUMENTS 5,797,176 A * 8/1998 Rose ..... A63B 53/0487 473/340
5,830,078 A * 11/1998 McMahan ..... A63B 60/02 473/341
6,663,497 B2 12/2003 Cameron
7,074,132 B1 * 7/2006 Finn ..... A63B 53/0487 473/335
7,156,752 B1 * 1/2007 Bennett ..... A63B 60/02 473/340
7,186,185 B2 * 3/2007 Nagy ..... A63B 60/02 473/238
7,351,162 B2 * 4/2008 Soracco ..... A63B 60/02 473/340
7,396,289 B2 * 7/2008 Soracco ..... A63B 53/0487 473/340
7,455,599 B2 * 11/2008 Jones ..... A63B 53/0487 473/340
7,491,131 B2 2/2009 Vinton
7,625,298 B2 * 12/2009 Bennett ..... A63B 53/02 473/341
7,918,745 B2 * 4/2011 Morris ..... A63B 53/04 473/340
8,096,039 B2 * 1/2012 Soracco ..... A63B 53/0487 473/340
D669,145 S 10/2012 Roland
8,308,583 B2 * 11/2012 Morris ..... A63B 60/02 473/340
D680,181 S 4/2013 Roland
8,956,245 B2 * 2/2015 Brandt ..... A63B 53/04 473/340
9,044,662 B2 * 6/2015 Demkowski ..... A63B 69/3685
9,072,951 B1 7/2015 Tang et al.
9,259,627 B1 2/2016 Myers et al.
9,604,108 B1 * 3/2017 Dunnell ..... A63B 60/02
9,844,707 B2 * 12/2017 Davis ..... A63B 53/02
10,596,428 B1 3/2020 Rumble
2002/0025859 A1 * 2/2002 Finn ..... A63B 60/42 473/340
2004/0063516 A1 * 4/2004 Cameron ..... A63B 53/0487 473/340
2004/0266543 A1 * 12/2004 Goldsmith ..... A63B 53/0487 473/251
2005/0164805 A1 * 7/2005 Durnin ..... A63B 60/02 473/340
2005/0221908 A1 * 10/2005 Gornall ..... A63B 53/007 473/285
2005/0255930 A1 * 11/2005 Johnson ..... A63B 69/3617 473/340
2006/0040763 A1 * 2/2006 Soracco ..... A63B 60/02 473/409
2006/0040764 A1 * 2/2006 Soracco ..... A63B 53/0487 473/340
2006/0100030 A1 * 5/2006 Hasegawa ..... A63B 60/02 473/340
2006/0189408 A1 * 8/2006 Grace ..... A63B 60/02 473/340
2006/0223650 A1 * 10/2006 Lai ..... A63B 60/00 473/340
2007/0155537 A1 * 7/2007 Morris ..... A63B 60/02 473/340
2007/0191130 A1 * 8/2007 Kouldus ..... A63B 60/02 473/251
2007/0243943 A1 * 10/2007 Inouye ..... A63B 60/02 473/340
2008/0009361 A1 * 1/2008 Johnson ..... A63B 53/0487 473/340
2008/0176672 A1 * 7/2008 Roach ..... A63B 60/02 473/340
2009/0098947 A1 * 4/2009 Bennett ..... A63B 53/04 473/340
2011/0190070 A1 * 8/2011 Morris ..... A63B 53/0487 473/251
2012/0122607 A1 * 5/2012 Reinberg ..... A63B 60/02 473/334
2015/0151169 A1 * 6/2015 Davis ..... A63B 53/02 473/313
2016/0023059 A1 * 1/2016 Miller ..... A63B 60/02 473/337
2016/0114230 A1 * 4/2016 Jones ..... A63B 53/0487 473/333
2017/0014689 A1 * 1/2017 Davis ..... A63B 53/007
2024/0226673 A1 7/2024 Cleghorn et al.
2025/0114669 A1 4/2025 Zimmerman et al.

* cited by examiner

SECTION A-A

SECTION C-C

SECTION D-D

SECTION F-F

PUTTER HEAD WITH REMOVABLE WEIGHTED ARTIFACT

RELATED APPLICATIONS

This application claims priority to U.S. Provisional Application 63/846,109, filed Jul. 17, 2025, the contents of which are hereby incorporated herein by reference.

BACKGROUND OF THE INVENTION

Field of the Invention

The present invention relates generally to golf clubs, and more specifically, to weighted putter heads.

Description of Related Art

The game of golf, or simply "golf", has a long and storied history, with its origins generally accepted as dating back to 15th century Scotland. Golf spread from Scotland throughout the rest of Europe during the 16th century and was officially recognized as a sport in the 18th century when the first club was formed, known as the Gentlemen Golfers of Leith, and an annual competition was established. From the 17th century onward, golf was exported from Europe with the rise of the British Empire and gained popularity across British colonies worldwide. By the mid-1700s, golf had arrive in what would become the United States. Since these early days, golf has exploded in popularity in the United States, with more than 16,000 golf course open and operating today. Almost half of the golf course worldwide are located in the United States today.

Along with the growth in popularity for golf, the equipment used to play the game has also changed significantly over the centuries. In the early days, golf was played with a set of handcrafted wooden clubs having a wooden shaft and a wooden head. Similar to today, there were several different styles of clubs depending on the distance a player needed to hit the ball. Eventually, the wooden club head was replaced with a cast iron head for most clubs. However, it was not until the late 1800s that putter heads began being made from iron and other metals.

The putter is the club a player uses for the final series of shots after reaching the green. The putter and putting stroke is unique to golf and this club is typically only used when on the green. A putting stroke does not involve a full swing, like a driver or iron shot would, but instead requires precision and control to allow the player to roll the ball along a precise line to reach the hole. An ideal putting stroke may only involve a maximum backswing of 12 to 16 inches. Typically, the putter head is swung forward in a pendulum-type motion so that the head meets the ball at the center of the stroke to propel it forward. At the end of the putting swing, the putter head may achieve a maximum rise of only a few inches above ground.

A putter is typically designed to have a vertically flat impact face so that when the ball is struck it will roll along the green instead of being lofted into the air. The body of the putter head is typically solid and is weightier than the other clubs a player might use. Throughout the 1900s, various putter head designs were introduced that replaced earlier designs. Today, putter heads can come in one of several designs, such as a blade putter or a mallet putter. The blade putter most closely resembles putter designs that were popular in the 1900s that have a vertically flat impact face and a body formed behind the impact face. The body of a blade putter head is typically machined or cast from metal to add weight to the head and establish a desired center of gravity. The body may only extend half an inch to an inch behind the impact face. In contrast, a mallet putter is typically heavier than a blade putter, and the head of the mallet putter has a body that extends more than an inch behind the impact face. Some mallet putter heads may have a rectangular or rounded body extending rearward from the impact face. Again, these are typically machined or cast from metal and formed to locate the center of gravity at an optimal point on the putter.

Some putter heads today offer the player the ability to customize the weight of the head by adding or removing small weights attached to the head. The customization, however, is limited to minor weight alterations that do not affect the overall appearance of the putter head. These putters allow a player to change the center of gravity of the putter head to match their specific stroke. For instance, U.S. Pat. No. 7,156,752 (the "'752 Patent") discloses variously styled putter heads that have one or more threaded apertures to receive a threaded weight. In some embodiments of the '752 Patent, the weights are completely enclosed within a housing extending rearwardly from the impact face, e.g., for a mallet style putter, while in other embodiments the weights are directly attached to the rear of the impact face, e.g., for a blade style putter. These weights are fixed to the putter head and cannot move during the putting stroke to ensure compliance with the rules of golf, which require that the characteristics of the a club cannot be changed during play, i.e., the center of gravity must remain fixed during play.

A problem with existing putter designs is the lack of customizability in a modern world where each consumer prefers to equip himself with articles that are unique to the player. While putter head designs in general may be unique from each other, i.e., blade versus mallet, the player has limited options to customize the head apart from picking the style of putter and the limited ability to alter the weight of the putter head.

What is needed is putter head that allows a player to alter the weight of the putter head and customize the aesthetic appearance of such head without sacrificing performance.

SUMMARY OF THE INVENTION

The following disclosure presents exemplary embodiments for various putter heads that are aesthetically and functionally customizable. The disclosed invention can provide a putter head in a hybrid-blade style, a mallet style, and a hybrid-mallet style to allow the player to change the weight of the putter head, alter the center of gravity, and attach various artifacts in the form of sculptures, figurines, or three-dimensional models that change the aesthetic appearance of the club. The performance of the club may be altered by the player through the selection of the artifact, the relative positioning of the artifact in regard to the impact face, and the selected weight attached thereto.

In a first embodiment of the present invention, a putter head is disclosed. The putter head has a body that defines a top surface, a bottom surface, and an impact face that is formed between the top surface and the bottom surface. A platform extends from the body in a direction opposite the impact face, i.e., rearward. A means for engaging a putter shaft extends from the top surface of the body. The putter shaft engagement means may include a hosel or may include a putter shaft being directly attached into the body of the putter head. A weighted artifact extends from the platform above a top plane of the impact face. This places the removable weight substantially above the top plane of the impact face. A means for removably attaching the weighted artifact to the platform is also included.

In some embodiments, the platform is formed as substantially circular base that extends rearwardly from the body. The circular base is substantially coplanar with the bottom surface of the body. The removable attachment means may include a plurality of magnets embedded in the circular base. The magnets may be symmetrically arranged around a perimeter of the circular base, e.g., every 60-degrees. The weighted artifact preferably includes a plurality of magnets that are arranged complementary to the magnets embedded in the circular base. In such embodiments, the removable attachment means includes the magnetic connection between the weighted artifact and the circular base.

In other embodiments where the platform is formed as a circular base, a lip extends around the perimeter of the base to define a depth. Preferably, the weighted artifact is designed to fit within the depth of the circular base formed by the lip. The removable attachment means may include a friction-fit of the weighted artifact within the depth of the circular base. Alternatively, the removable attachment means may be a threaded connection between the weighted artifact and the circular base, the threads being formed around the internal perimeter of the circular base and complementary threads formed around a lower end of the weighted artifact.

In some embodiments, the weighted artifact includes a base and an artifact extending vertically from the base. The base is configured for attachment to the platform via the removable attachment means. In some embodiments, the artifact itself is weighted, e.g., a sculpture or figurine formed from metal. Alternatively, the artifact may enclose one or more weights, such as small metal discs. The artifact is positioned above the top plane of the impact face, placing the weight above the top plane of the impact face.

In some embodiments, the platform is formed as a mallet extending rearwardly from the body. Similarly, in some embodiments, the platform may include alternatively shaped bases, such as triangular, rectangular, hexagonal, among other geometric shapes. The platform base, in whatever geometric shape, is designed to engage the weighted artifact, which preferably includes a complementary-shaped base end for engagement with the platform base.

In further embodiments, the body defines a toe end and a heel end. The platform extending from the back side of the body may include a wing arching off a rear end of the platform between the toe end and the heel end of the body. The arched wing includes a toe tip proximate the toe end of the body and a heel tip proximate the heel end of the body. Preferably, each of the toe tip and the heel tip angle upward toward the top plane of the impact face. The toe tip and the heel tip, however, do not touch the body of the club head, leaving a space between the terminal ends of the arched wing and the body. The arched wing otherwise is substantially coplanar with the bottom surface of the body.

In preferred embodiments, the weighted artifact is rotatable around the platform.

In some embodiments, the weighted artifact is a sculpture or a figurine. In alternative embodiments, the weighted artifact is a three-dimensional model of a famous golf course hole, such as the 16th hole at TPC Scottsdale or the 12th hole at Augusta National. Any golf course hole may be made into a two-dimensional or a three-dimensional model formed as the weighted artifact according to the present invention. Similarly, any sculpture or figurine may be formed into the artifact, e.g., a superhero figurine or sculpture. The weighted artifact may be cast or machined from various types of metal or, alternatively, injection molded from one or more polymers, such as polyoxymethylene. In alternative embodiments, the weighted artifact may be formed from one or more of a variety of materials, includes plastics, metal, rubber, carbons, graphite, etc. The exact material selected for the weighted artifact may influence the relative size of the artifact given the need to maintain balance of the putter head with the other components present, namely, the body.

Preferably, the weighted artifact has a base that is configured to engage the platform via the removable attachment means and an asymmetric artifact that extends vertically from the base. The weighted artifact is preferably rotatably engaged to the platform so that the weighted artifact can be rotated relative to the platform. In some embodiments, the asymmetric artifact extends forward beyond the impact face and above the top plane thereof. In alternative embodiments, the asymmetric artifact is arranged to be parallel to the impact face while above the top plane thereof. The rotatability of the weighted artifact allows a player to arrange the asymmetric artifact in any desired position relative to the impact face. In some embodiments, the forward plane of the asymmetric artifact is positioned behind the impact face and above the top plane thereof. The asymmetric artifact may include an uneven weight distribution. The uneven weight distribution may include a heavier left, right, front, or back side when compared to any of the other sides of the asymmetric artifact. As such, the putter head is engineered so that the center of gravity changes based on the orientation of the asymmetric artifact relative to the impact face.

In some further embodiments, the platform includes a circular base extending rearward from the body and having a lip formed around a perimeter and defining a depth. The weighted artifact includes an artifact extending vertically from a base that is complementary to the circular base. The removable attachment means may include a threaded connection between the circular base and the base of the weighted artifact or a friction fit of the artifact base within the depth of the circular base.

In some preferred embodiments, the body of the putter head is formed from machined metal. The metal may be titanium, stainless steel of any grade, and/or zirconium. In other preferred embodiments, the weighted artifact may include an asymmetrical weight distribution above the top plane of the impact face.

In some further alternative embodiments, the weighted artifact may be composed of two pieces that are removably coupled together and removably coupled to the platform via the removable attachment means. Such embodiments may include a weighted artifact base that has a bottom surface and a top surface. The bottom surface is designed to removably couple to the platform via the removable attachment means. The top surface is designed to removably couple to a weighted artifact to position the artifact above the top plane of the impact face. The top surface thus may include a plurality of magnets embedded therein while the artifact includes one or more complementary magnets embedded in the bottom surface of the artifact. In some preferred embodiments, the base may be formed substantially in the shape of a golf ball, having a flat bottom surface to engage the platform and a flat top surface to engage the weighted artifact. However, it should be recognized that various other geometric shapes or designs may be used for the artifact base so long as the bottom surface is made complementary to the platform to be coupled therewith via the removable attachment means, and so that the top surface of the base is configured to engage a desired artifact.

The weighted artifact may be a sculpture or a two-dimensional or three-dimensional model, such as a three-dimensional model of a famous golf hole like the 16th hole at TPC Scottsdale. In such embodiments, the player is provided with additional customizability for their putter head in that different artifact bases may be coupled to different types of weighted artifacts, e.g., a sculpture, a figurine, and/or a 2D or 3D model, without having to change the putter head.

In further embodiments of the invention, there is disclosed a putter head having a body that defines a top surface, a bottom surface, and an impact face formed between the top surface and the bottom surface. A platform extends in a direction perpendicular to the impact face. A means formed in the top surface for engaging a putter shaft is included. A weighted artifact extends from the platform above the top surface and there is a means for removably attaching the weighted artifact to the platform. In some embodiments, the platform is substantially circular.

In some further embodiments, the platform includes at least one first aperture defined therethrough and the weighted artifact includes at least one second aperture defined therein. The removable attachment means may include at least one screw that is extendable through the at least one first aperture and engageable with the at least one second aperture.

In further preferred embodiments, the removable attachment means may include a plurality of magnets embedded in the platform and a plurality of complementary magnets embedded in a bottom surface of the weighted artifact to magnetically attach the weighted artifact to the platform. The removable attachment means may also include a screw threadably engageable through complementary apertures defined through the platform and in the weighted artifact. In further embodiments, the removable attachment means also includes a means for rotatably attaching the weighted artifact to the platform.

Preferably, the platform includes a lip extending around a perimeter of the platform and defining a depth. The removable attachment means may be designed as a friction-fitment of the weighted artifact to the platform within the depth formed by the lip. In some further embodiments, the platform may include a plurality of dimples defined within the perimeter of the lip and the weighted artifact includes a plurality of bosses that are arranged complementary to the dimples. The bosses extend downward from a bottom surface of the weighted artifact.

In some further alternative embodiments, the removable attachment means is designed as a bayonet connection. As such, the lip of the platform includes two or more slots formed therein. Each slot forms a ledge in the lip. The weighted artifact includes two or more arms extending downward from a perimeter of the bottom surface. The arms are preferably arranged to be complementary to the slots.

In other embodiments, the weighted artifact includes a base and an ornament. The base may include a means for removably and rotatably attaching the ornament to the base. In some preferred embodiments, the removable attachment means and the removably and rotatably attaching means have an identical configuration. The ornament of a weighted artifact may be a symmetrical or asymmetrical sculpture or model.

In further embodiments, the invention relates to a putter head having a body that defines a top surface, a bottom surface, and an impact face. A platform extends perpendicular to the impact face. Formed in the top surface is a means for engaging a putter shaft. A weighted artifact extends from the platform above the top surface. The weight artifact includes a base having a top surface and a bottom surface, and an ornament removably and rotatably coupled to the top surface. The putter head includes a means for removably attaching the base to the platform. Preferably, the bottom surface of the base has a configuration that is complementary to the platform. The removable attachment means may include a plurality of complementary magnets embedded in the platform and in the bottom surface of the base. Preferably, the plurality of complementary magnets are radially symmetrically arranged to allow the base to be rotated around the platform relative to the impact face.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments of a functionally and aesthetically customizable putter head. The putter head according to the present invention allows a player to customize the aesthetic appearance of the putter head by offering a selection of various weighted artifacts that can be removably coupled to the putter head and also provides for customization of the functionality of the putter head by allowing the player to readily modify the weight of the putter head based on the selection of the weighted artifact that is engaged thereto. The functionality of the putter head is also modified based on the relative positioning of the weighted artifact in regard to the impact face, which alters the weight distribution of the putter head.

In preferred embodiments, the putter head according to the present invention is machined titanium or titanium alloys. In other embodiments, the putter head may be machined from various grades of stainless steel, tungsten, copper and other metals and alloys thereof. The weighted artifact removably coupled to the putter head, as described further below, may also be machined from various types of metal or alternatively, injection molded or by additive manufacturing processes, e.g., 3-D printing. In some embodiments, the weighted artifact is formed from aluminum, titanium, various grades of stainless steel, copper, tungsten, or various alloys of any of the aforementioned materials. In some embodiments, the weighted artifact may be molded or printed from one or more polymer materials, rubber materials, or metals. The material selected for the weighted artifact will determine the weight of that piece of the putter head and its impact on the customization of the putter head. In some embodiments, the weighted artifact is weighted based on the materials used to manufacture it. Alternatively, the weighted artifact may be formed to enclose one or more individual weights, which may provide a symmetric or asymmetric weight distribution for the weighted artifact.

Figure 1:
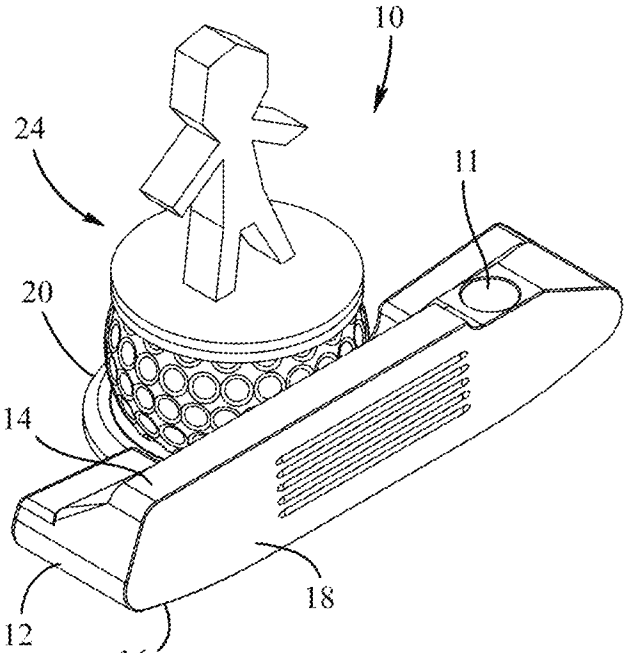
FIG. 1 is a perspective front view of an embodiment of a putter head according to the present invention.

FIG. 1 is a front perspective view of a first embodiment of a putter head according to the present invention. The putter head 10 includes a body 12 defining a top surface 14 and a bottom surface 16. An impact face 18 is defined between the top surface 14 and the bottom surface 16. The impact face 18 is substantially flat and vertically oriented to extend between the top surface 14 and the bottom surface 16. The impact face 18 is the portion of the putter head 10 designed to strike the golf ball during a normal putting stroke. In some embodiments, the impact face 18 may be textured or powder coated. The top surface 14 also includes a means for engaging a putter shaft. The putter shaft engagement means 11 may be a conventional hosel or an aperture designed to directly receive the putter shaft. The putter shaft engagement means 11 may be formed at any position along the top surface 14 of the body 12, e.g., left, center, or right ends of the body, as is known for existing putters.

Figure 2:
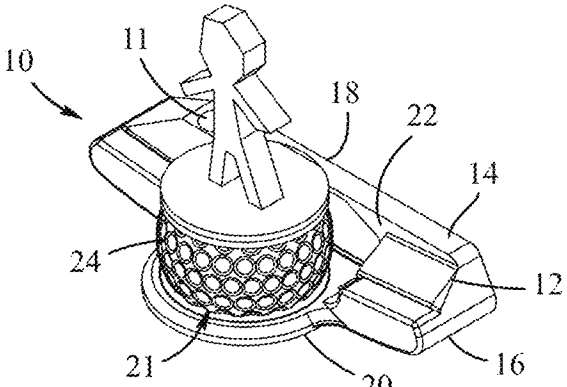
FIG. 2 is a perspective rear view of an embodiment of a putter head according to the present invention.

FIG. 2 is a rear perspective view of the first embodiment of a putter head according to the present invention. The hybrid-blade body 12 of the putter head 10 also includes a platform 20 extending perpendicular to the impact face 18. Said another way, the platform 20 extends from the rear side 22 of the body 12. A weighted artifact 24 is removably and rotatably coupled to the platform 20. As discussed in further detail below, the platform 20 has a means 21 for removably attaching the weighted artifact 24 to the platform. In most preferred embodiments, the removable attachment means 21 also provides for the rotatability of the weighted artifact 24 with regard to the impact face 18, e.g., the weighted artifact 24 can be rotated 360-degrees around the platform 20 with regard to the impact face 18.

Figure 3:
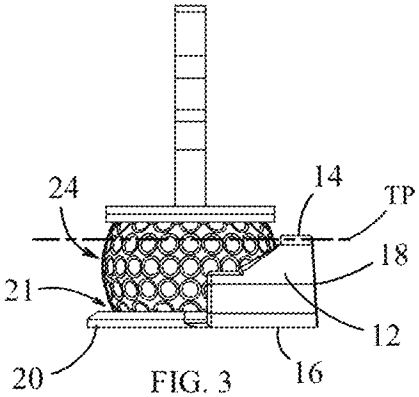
FIG. 3 is a side view of an embodiment of a putter head according to the present invention.

FIG. 3 is a side view of the first embodiment of the putter head according to the present invention. The weighted artifact 24 is designed to extend above the top plane TP of the impact face 18, which places a portion of the weight added to the putter head 10 by the weighted artifact 24 above the top surface 14 of the body 12.

Figure 5:
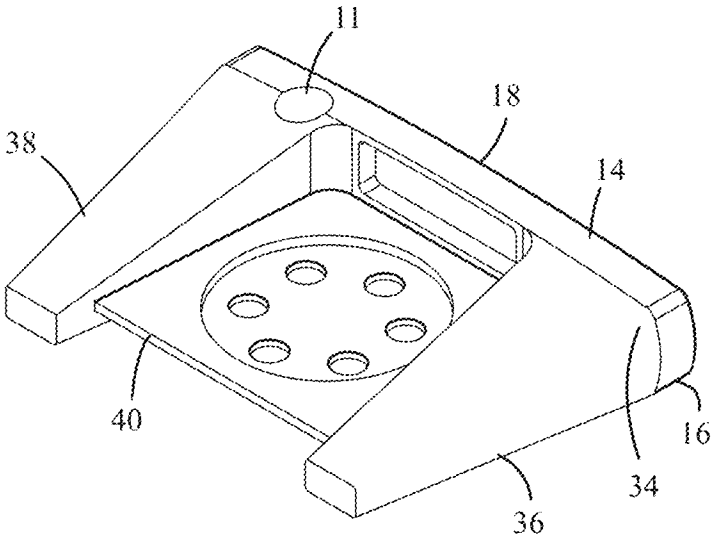
FIG. 5 is a perspective rear view of an embodiment of mallet putter head according to the present invention.
Figure 6:
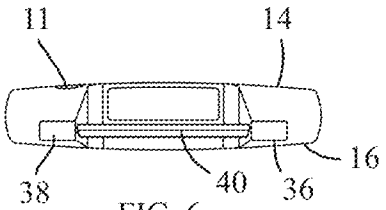
FIG. 6 is a rear view of the mallet putter head shown in FIG. 5.
Figure 4:
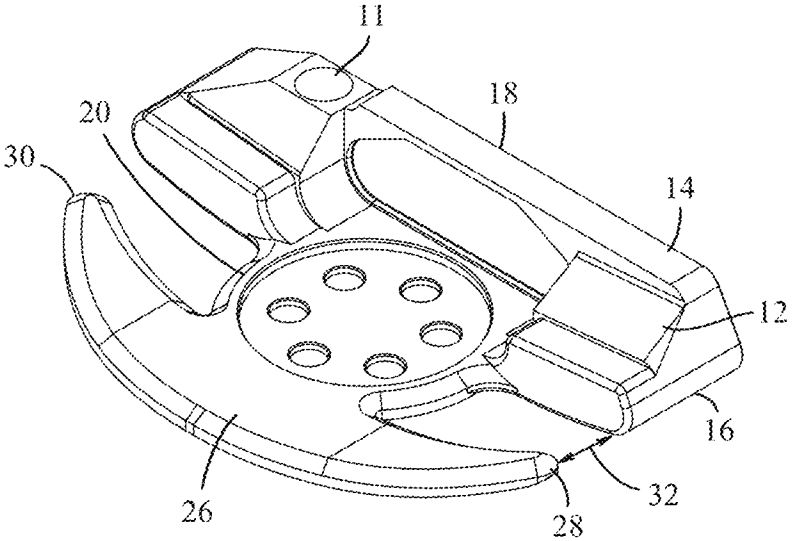
FIG. 4 is a perspective rear view of an embodiment of a winged-blade putter head according to the present invention.

The putter head 10 according to the present invention may assume a variety of different body styles. FIGS. 1-3 illustrate a hybrid-blade body 12 style for the putter head 10. FIGS. 4 through 6 illustrate alternative body styles of the putter head 10 according to the present invention.

FIG. 4 is a rear perspective view of an embodiment of a putter head having a winged-blade body design. FIG. 5 is a rear perspective view of an embodiment of a putter head having a mallet body design. FIG. 6 is a back view of the mallet body design shown in FIG. 5. The putter heads shown in FIGS. 4-6 are substantially similar to that shown in FIGS. 1 through 3 and thus each include a top surface 14, a bottom surface 16, an impact face 18 formed between the top surface 14 and the bottom surface 16, and a platform 20 extending in the direction opposite from the impact face 18.

The putter head shown in FIG. 4 includes a hybrid-blade body 12 with the platform 20 extending substantially perpendicular to the impact face 18. A wing 26 extends from the back side of the platform 20. The wing 26 is preferably integrally formed with the platform 20. The wing 26 extends between a toe end 28 and a heel end 30. The wing 26 curves between the toe end 28 and the heel end 30. Preferably, each of the toe end 28 and the heel end 30 angle upward toward the top surface 14 of the body 12. Each of the toe end 28 and the heel end 30 of the wing 26 are separated from the body 12 by an air gap 32. The presence of the air gap 32 reduces the material used for the putter head 10 and thereby reduces the weight of the putter head. A weighted artifact 24, not shown in FIG. 4, is removably and rotatably attached to the platform 20 via the removable attachment means 21, as discussed further below.

The putter head shown in FIG. 5 has a mallet body 34 extending in the opposite direction from the impact face 18. The mallet body 34 is formed by two legs 36, 38 extending substantially parallel with one another. A platform 40, similar to platform 20 discussed above, is formed between the two legs 36, 38. The platform 40 is integrally formed with the legs 36, 38. In some embodiments, such as that shown by FIGS. 5-6, the platform 40 is raised above the bottom surface 16. In alternative embodiments, the platform 40 may be coplanar with the bottom surface 16 extending between the two legs 36, 38.

In the following discussion, it should be understood that the previous putter head body styles, e.g., hybrid-blade shown in FIGS. 1-3, the winged-blade style shown in FIG. 4, and the mallet style shown in FIG. 5-6, may be generally referred to as putter head 10 having a body 12. The following discussion thus is meant to apply generally to each of the three previously described putter head body styles. For sake of simplicity, only the hybrid-blade body is depicted throughout the following drawings but it should be understood that the features described in the following paragraphs may be equally applied to any of the other putter head body styles described above.

Figure 9:
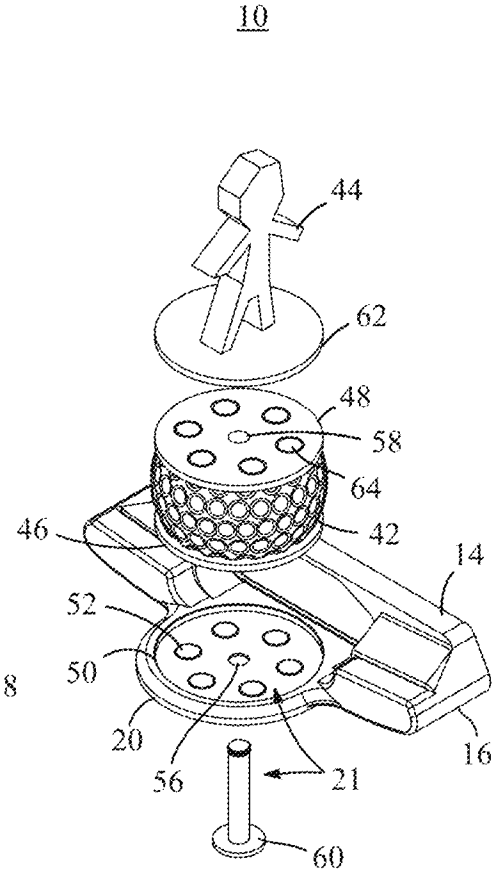
FIG. 9 is an exploded perspective view of the putter head shown in FIG. 7.
Figure 8:
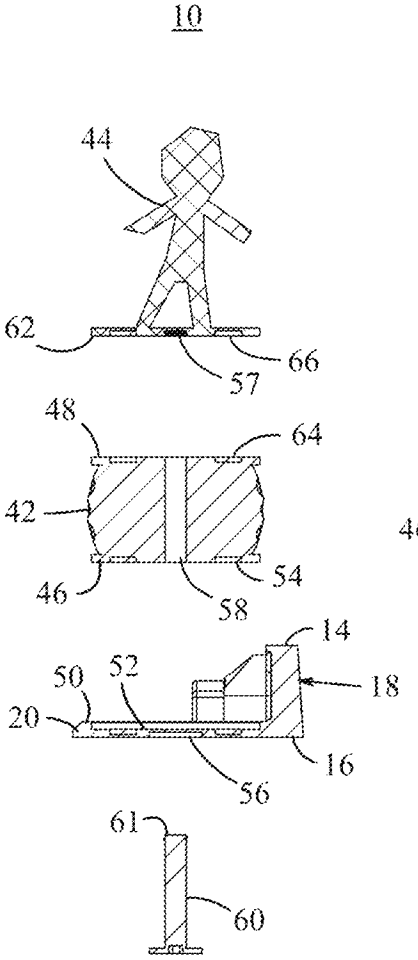
FIG. 8 is an exploded cross-sectional view, taken along line A-A, of the putter head shown in FIG. 7.
Figure 7:
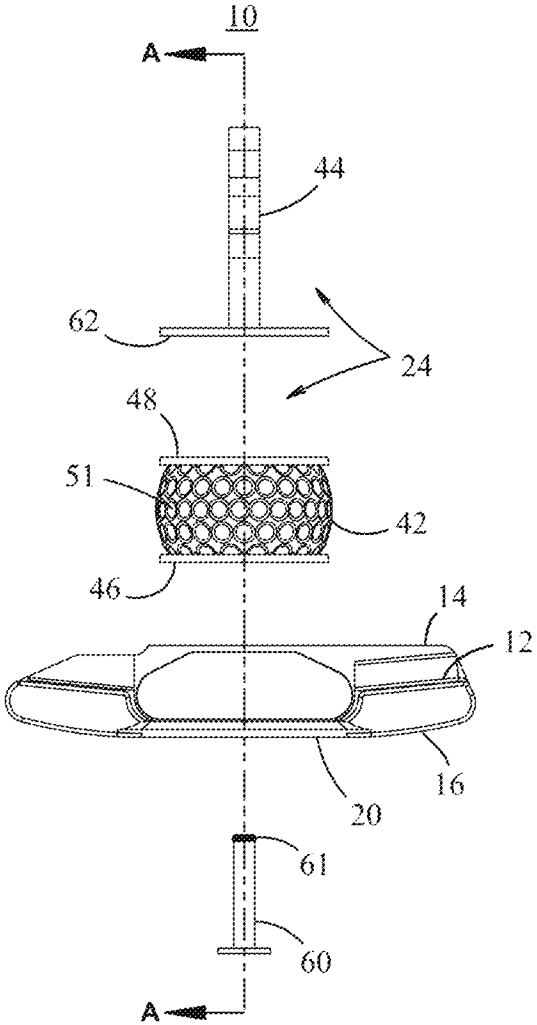
FIG. 7 is an exploded rear view of a putter head having a first embodiment of a removable attachment means for a weighted artifact according to the present invention.

FIGS. 7 through 9 are various views of a putter head 10 having a first embodiment of the removable attachment means 21. FIG. 7 is an exploded side view of a putter head 10; FIG. 8 is an exploded side cross-sectional view, taken along lines A-A; and FIG. 9 is an exploded perspective view of the same putter head. In some embodiments, the weighted artifact 24 includes a base 42 and an ornament 44. The base 42 and the ornament 44 in some embodiments are separate pieces that are removably coupled together. In alternative embodiments, the base 42 and the ornament 44 are a single piece forming the weighted artifact 24, e.g., the ornament 44 is integrally formed with the base 42 as a single piece.

The base 42 includes a bottom surface 46 and a top surface 48. In some embodiments, such as those shown in FIGS. 7-9, the base 42 may be substantially spherical and includes dimples 51 formed in the outer surface to give the appearance of a golf ball. The bottom and top surfaces 46, 48 are preferably planar and designed to be complementary with the platform 20 and the ornament 44.

In some preferred embodiments, the platform 20 includes a lip 50 formed around the outer perimeter thereof and which defines a depth. The removable attachment means 21 for attaching the weighted artifact 24 to the platform 20 may include a plurality of magnets. Preferably, the platform 20 includes a first set of magnets 52 embedded in the platform 20 and arranged within perimeter of the lip 50. Similarly, the bottom surface 46 of the base 42 includes a second set of magnets 54 arranged to mirror the first set of magnets 52 allowing the weighted artifact 24 to be magnetically attached to the platform 20. The mirrored arrangement of the first and second sets of magnets 52, 54 also allows the weighted artifact 24 to be rotated around the platform 20 relative to the impact face 18. In one embodiment, the first set 52 and second set 54 of magnets each include six magnets radially symmetrically arranged, which allows the weighted artifact 24 to be rotated in 60-degree increments about the platform 20. In alternative embodiments, there may be more or less than six magnets to provide for more discreet or larger increments of rotation for the weighted artifact 24 around the platform 20 relative to the impact face 18.

The platform 20 may also include one or more apertures 56 defined through the platform and configured to align with one or more apertures 58 defined through the base 42. The base aperture 58 may include internal threads that are complementary to the external threads 61 of a screw 60. The weighted artifact 24 may be locked onto the platform 20 by a screw 60 threadably engaged with the complementary apertures 56, 58. The screw 60 may form part of the removable attachment means 21. Preferably, complementary apertures 56 and 58 are arranged at the center of the platform 20.

When discussing two or more apertures, e.g., apertures 56 and 58, being arranged complementary to one another, it should be understood that this is meant to convey that a single fastener, such as screw 60, is extendable through and engageable with the complementary apertures.

In some embodiments, the ornament 44 is removable from the top surface 48 of the base 42. The ornament 44 may include an ornament base 62 that is complementary to the top surface 48 of the base 42. In some embodiments, the top surface 48 may include a plurality of magnets 64 embedded therein and arranged to mirror a plurality of magnets 66 embedded in the ornament base 62 to facilitate a magnetic connection between the base 42 and the ornament 44. The ornament 44 may further include a threaded aperture 57 defined in the ornament base 62. The threaded aperture 57 is similarly arranged to be complementary to the apertures 56, 58 defined through the platform 20 and base 42 to facilitate receiving the screw 60 therethrough. The threaded aperture 57 engages the threaded end 61 of the screw 60 to secure the weighted artifact 24 to the platform 20 in addition to the magnetic connection provided by the removable attachment means 21. The screw 60, when engaged through the platform 20 and into the weighted artifact 24, is flush with the bottom surface 16 of the putter head 10.

Figure 12:
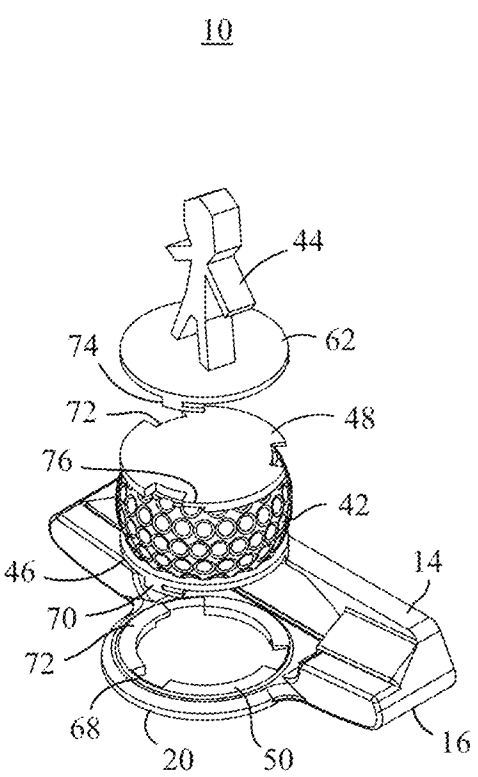
FIG. 12 is an exploded perspective view of the putter head shown in FIG. 10.
Figure 11:
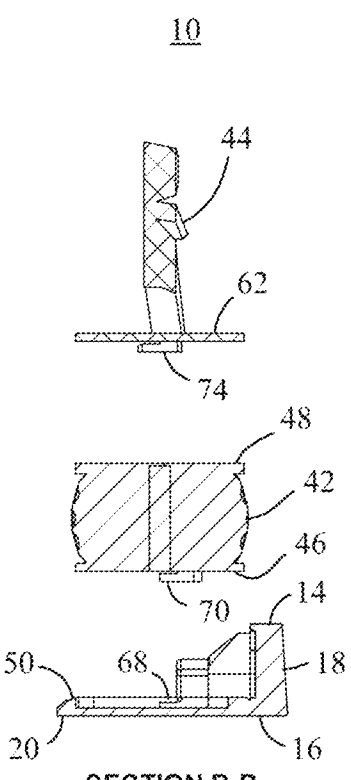
FIG. 11 is an exploded cross-sectional view, taken along line B-B, of the putter head shown in FIG. 10.
Figure 10:
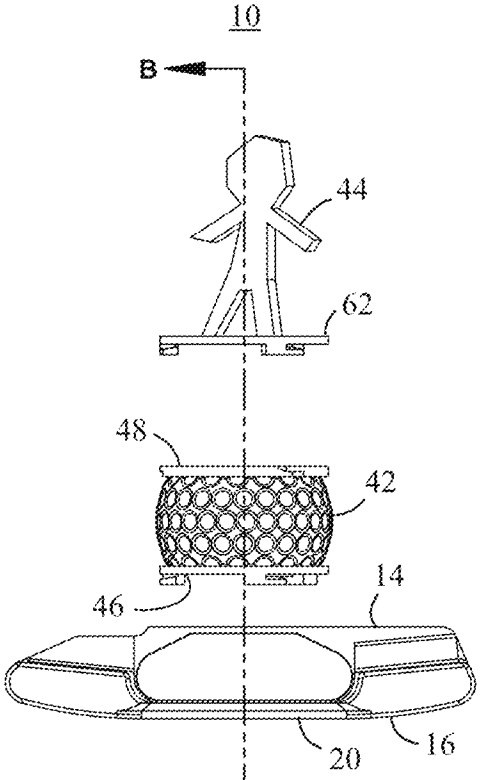
FIG. 10 is an exploded rear view of a putter head having a second embodiment of a removable attachment means for a weighted artifact according to the present invention.

FIGS. 10 through 12 are various views of a putter head 10 according to the present invention having an alternative embodiment of the removable attachment means 21. Many of the same features described above are present in the following embodiments. Thus, the putter head 10 has a platform 20 extending from the body 12 in the direction opposite from the impact face 18. The weighted artifact 24 includes a base 42 and an ornament 44. The base 42 has a bottom surface 46 designed to interface with the platform 20 via the removable attachment means 21 and a top surface 48 configured to engage the ornament 44. The base 42 and ornament 44 may be removably coupled together or formed as a single piece where the ornament 44 is integrated with the base 42.

In some embodiments, such as those depicted among FIGS. 10-12, the removable attachment means 21 is formed as a bayonet connection or twist-lock interface. The platform 20 includes the lip 50 formed around the perimeter thereof. The lip 50 includes one or more slots 68 designed to interface with one or more arms 70 extending from the bottom surface 46 of the base 42. The arms 70 are arranged to be complementary with the slots 68 to allow the base 42 to lock onto the platform 20. The removable attachment means 21 is thus designed so that once the base 42 is positioned on the platform 20 and the arms 70 are arranged within the slots 68, the base 42 is locked onto the platform 20 by rotating the base 42 causing the arms 70 to move under the ledge 72 created by the slots 68 within the lip 50 of the platform.

In some preferred embodiments, there are three slots 58 and three arms 70, each arranged radially every 120-degrees around the diameter, to allow the weighted artifact 24 to be rotated relative to the impact face 18 in 120-degree increments. In alternative embodiments, there may be more or fewer than three slots 68 and arms 70 to provide the weighted artifact 24 with larger or smaller increments of rotation relative to the impact face 18.

In some embodiments where the ornament 44 is removable from the base 42, the ornament 44 and base 42 utilize the same configuration of removable attachment means 21 that provides for the weighted artifact 24 to attach to the platform 20. The top surface 48 of the base 42 may therefore include one or more secondary slots 72 formed around the outer perimeter thereof. The ornament base 62 similarly includes one or more secondary arms 74 extending downward and arranged to be complementary with the secondary slots 72. The locking interaction is similar to that described above. The ornament 44 is positioned on the top surface 48 of the base 42 with the secondary arms 74 arranged in the secondary slots 72. The ornament 44 is thereafter rotated relative to the base 42 causing the arms 74 to be locked under the one or more secondary ledges 76 formed by the slots 72. There may be three secondary slots 72 and secondary arms 74 to provide 120-degree increments of rotation of the ornament 44 around the base 42 relative to the impact face 18.

In preferred embodiments, the ornament 44 attaches to the base 42 in the same manner that the base 42 attaches to the platform 20. This allows a player to remove the base 42 component from the weighted artifact 24 and only use the ornament 44 as the weighted artifact 24 attached to the putter head 10. The usage of ornament 44 alone (i.e. without the base) alters the weight distribution of the putter head 10 and provides for added weight above the top surface 14. The weight distribution of the putter head 10 may be further modified using only the ornament 44 based on the relative orientation of the ornament 44 with regard to the impact face 18. In some embodiments where the ornament 44 is asymmetrical, the weight distribution for the putter head 10 may be altered depending on the orientation of the asymmetrical weighted artifact 24, i.e., ornament 44, relative to the impact face 18.

Figure 15:
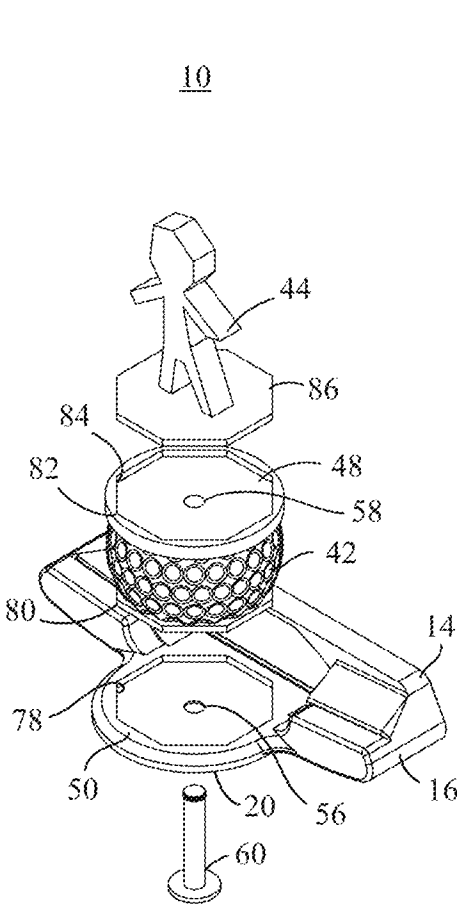
FIG. 15 is an exploded perspective view of the putter head shown in FIG. 13.
Figure 14:
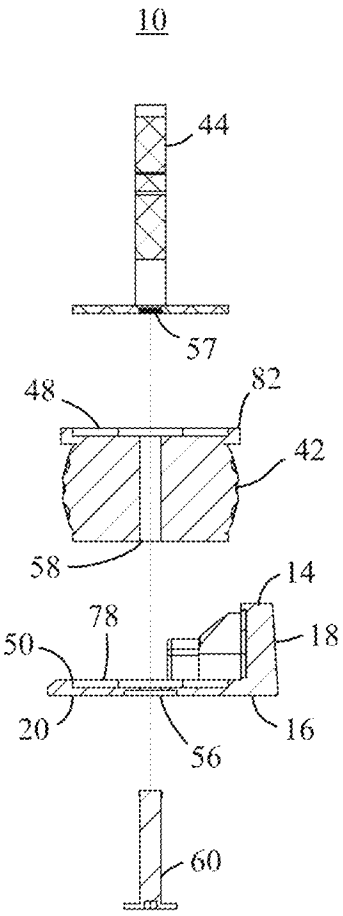
FIG. 14 is an exploded cross-sectional view, taken along line C-C, of the putter head shown in FIG. 13.
Figure 13:
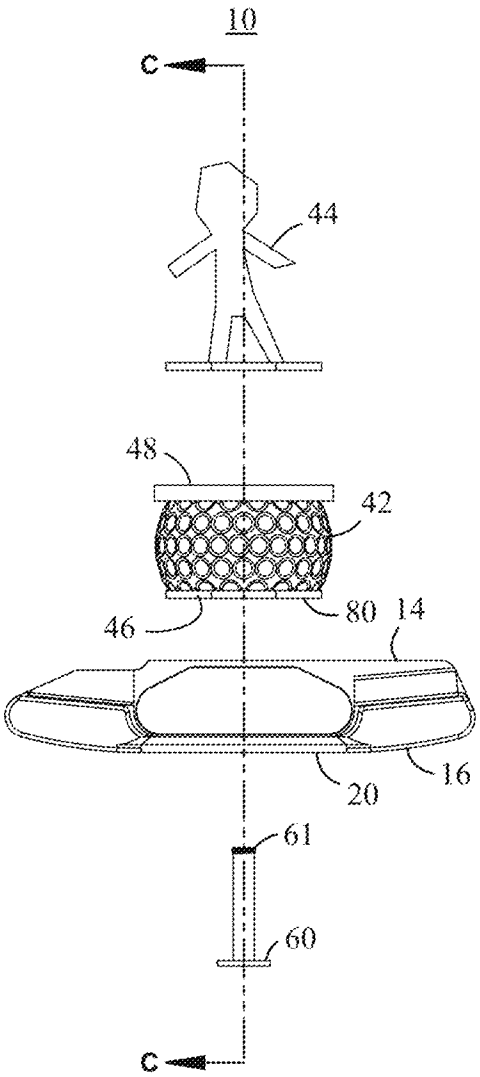
FIG. 13 is an exploded rear view of a putter head having a third embodiment of a removable attachment means for a weighted artifact according to the present invention.

In further embodiments, the removable attachment means 21 may be designed as a geometric friction-fit with one or more optional screws to provide for added strength to the connection. FIGS. 13-15 are various views of the putter head 10 according to the present invention having an alternative embodiment of the removable attachment means 21. FIG. 13 is an exploded rear view; FIG. 14 is an exploded cross-sectional view, taken along lines C-C; and FIG. 15 is an exploded perspective view. Many of the same features described above are present in the following embodiments. Thus, the putter head 10 has a platform 20 extending from the body 12 in the direction opposite from the impact face 18. The weighted artifact 24 includes a base 42 and an ornament 44. The base 42 has a bottom surface 46 designed to interface with the platform 20 via the removable attachment means 21 and a top surface 48 configured to engage the ornament 44. The base 42 and ornament 44 may be removably coupled together or formed as a single piece where the ornament 44 is integrated with the base 42.

In the embodiments illustrated by FIGS. 13 to 15, the removable attachment means 21 is designed as a geometric friction-fit. As such, the platform 20 includes a lip 50 that frames a geometric interface 78 that is configured to receive a complementary geometric base 80 formed by the bottom surface 46 of the base 42. In the depicted embodiment, the geometric interface 78 and the geometric base 80 are formed as complementary octagonal faces but it should be understood that any other conventional or unconventional geometric shape may be used to form the complementary faces. The geometric base 80 is designed to frictionally-fit within the geometric interface 78 to secure the base 42 to the platform 20. In the illustrated embodiment having complementary octagonal faces, the player may rotate the base 42 around the platform 20 in increments of 45-degrees relative to the impact face 18.

In embodiments where the ornament 44 is removable from the base 42, there is a similar attachment interface provided therebetween. The top surface 48 of the base 42 thus may include a lip 82 that frames a geometric top 84 that is configured to interface with a geometric ornament base 86. In preferred embodiments, the attachment interface between the ornament 44 and the base 42 has the same configuration as the removable attachment means 21 provided to attach the weighted artifact 24 to the platform 20. Thus, in the illustrated embodiments, the geometric top 84 and the geometric ornament base 86 are formed as complementary octagonal faces similar to those provided between the geometric base 80 and the geometric interface 78. The ornament 44 may thus be rotated around the top surface 48 of the base 42 relative to the impact face 18 in increments of 45-degrees.

In some embodiments, the friction-fitment between the geometric base 80 and the geometric interface 78 is sufficient to reliably attach the weighted artifact 24 to the platform 20. In some alternative embodiments, the platform 20 includes one or more apertures 56 defined therethrough and arranged to be complementary with one or more apertures 58 defined in the complementary base 42. The base aperture 58 may include internal threads that are complementary to threads 61 formed on screw 60. Similar to that described above, a screw 60 may be threadably engaged through the complementary apertures 56, 58 to secure the weighted artifact 24 to the platform 20.

In embodiments where the ornament 44 is removable from the base 42, the ornament 44 may include a threaded aperture 57 formed in the geometric ornament base 86 and arranged to be complementary to apertures 56, 58. In such embodiments, the screw 60 extends through apertures 56 and 58 and threadably engages with the threaded aperture 57 to secure the weighted artifact 24 onto the platform 20. In other embodiments, more than one screw 60 may be provided and more than one set of complementary apertures are defined through each of the platform 20, the base 42, and the ornament 44 to provide a more secure locking of the components to the putter head 10.

Figure 18:
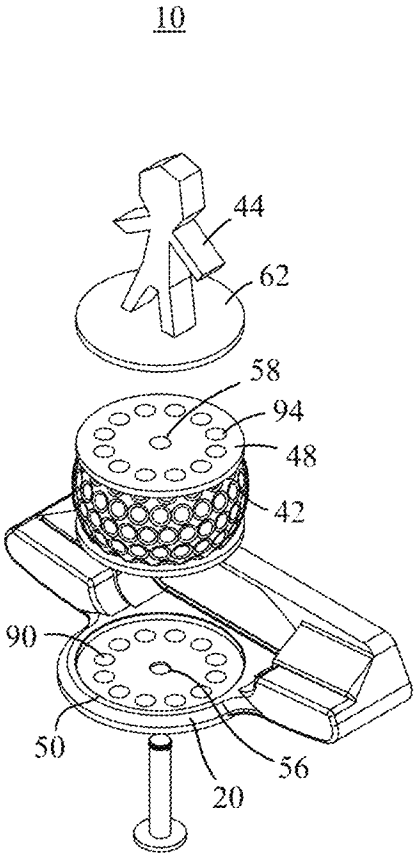
FIG. 18 is an exploded perspective view of the putter head shown in FIG. 16.
Figure 17:
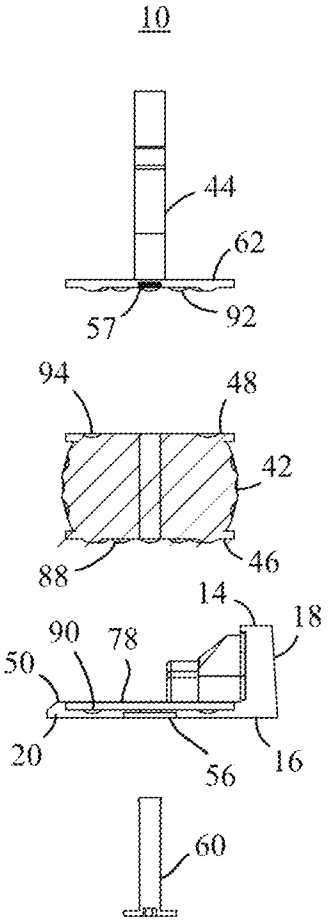
FIG. 17 is an exploded cross-sectional view, taken along line D-D, of the putter head shown in FIG. 16.
Figure 16:
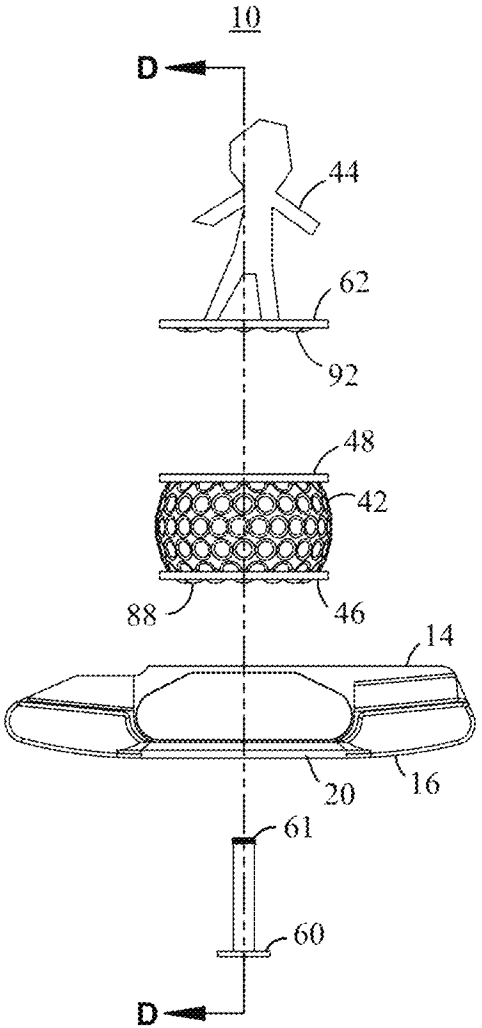
FIG. 16 is an exploded rear view of a putter head having a fourth embodiment of a removable attachment means for a weighted artifact according to the present invention.

In further embodiments, the removable attachment means 21 may be designed as a series of complementary dimples and bosses. FIGS. 16 through 18 are various view of the putter head 10 having an alternative embodiment of the removable attachment means 21. FIG. 16 is an exploded rear view; FIG. 17 is an exploded cross-sectional view, taken along lines D-D; and FIG. 18 is an exploded perspective view. Many of the same features described above are present in the following embodiments. Thus, the putter head 10 has a platform 20 extending from the body 12 in the direction perpendicular to the impact face 18. The weighted artifact 24 includes a base 42 and an ornament 44. The base 42 has a bottom surface 46 designed to interface with the platform 20 via the removable attachment means 21 and a top surface 48 configured to engage the ornament 44. The base 42 and ornament 44 may be removably coupled together or formed as a single piece where the ornament 44 is integrated with the base 42.

The embodiments illustrated by FIGS. 16-18 have a removable attachment means 21 formed as a series of complementary dimples and bosses. As such, the bottom surface 46 of the base 42 includes a plurality of bosses 88 that are arranged complementary to a plurality of dimples 90 formed in the platform 20. Preferably, the plurality of dimples 90 are formed within the perimeter of the lip 50 on the platform 20. Similar to previous embodiments, the platform 20 and the base 42 may include complementary apertures 56 and 58 configured to receive a threaded screw 60 to secure the weighted artifact 24 onto the platform 20. The weighted artifact 24 may be first set in its desired position relative to the impact face 18 and the screw 60 thereafter tightened to lock the bosses 88 into the dimples 90. The base aperture 58 may include internal threads that are complementary to threads 61 on the screw 60.

In embodiments where the ornament 44 is removable from the base 42, the ornament 44 is provided with an ornament base 62 having a plurality of secondary bosses 92 formed in the bottom surface thereof and arranged to be complementary to a plurality of secondary dimples 94 formed in the top surface 48 of the base 42. The ornament 44 may include a threaded aperture 57, similar to that described above, that is aligned with apertures 56, 58 to receive the screw 60. Threaded engagement of the screw 60 in the threaded aperture 57 serves to secure the weighted artifact 24 onto the platform 20. To facilitate rotation of the base 42, the ornament 44, or the entire weighted artifact 24 (i.e., both the ornament 44 and the base 42), the screw 60 is loosened or removed, allowing the player to rotate the piece relative to the impact face 18 prior to reinstalling the screw 60 to secure the components together.

In alternative embodiments, the bosses may be formed in the platform 20 and the dimples formed in the bottom surface 46 of the base 42. Similarly, the ornament base 62 may include the secondary dimples while the top surface 48 of the base 42 includes the secondary bosses.

In the previously described embodiments, the screw 60 was an optional component of the removable attachment means 21 and was preferably arranged for installation from a center of the platform 20 and corresponding weighted artifact 24. The friction-fitment between the bottom surface 46 of the base 42 with the platform 20, along with the additional features of the removable attachment means 21 discussed previously, may be sufficient to attach the weighted artifact 24 to the platform 20. The screw 60 is utilized to strengthen the connection of the weighted artifact 24 with the platform 20 but is not necessary to accomplish attachment of the weighted artifact 24 to the platform 20. A player may desire the addition of the screw 60, regardless of the embodiment of the removable attachment means 21 provided, given that it is normal for golf clubs to bounce around in a player's bag during play and during transit. Typically, golf clubs, including the putter, are loosely stored in a golf bag and tend to bounce around and bang into each other throughout the round of golf. The addition of the screw 60 in combination with the removable attachment means 21 ensures that the weighted artifact 24 does not disengage from the platform 20 during transit to and on a course.

In some simpler embodiments, the removable attachment means 21 is formed simply as two or more screws that extend through the platform 20 and into the weighted artifact 24.

Figure 21:
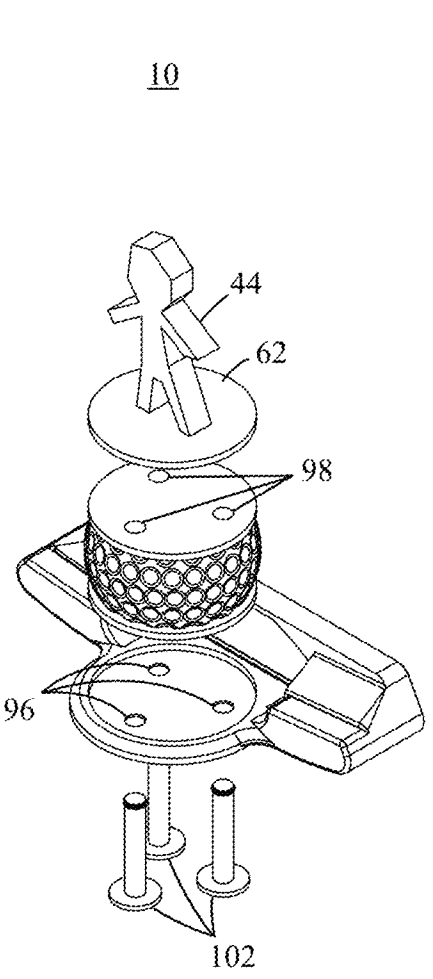
FIG. 21 is an exploded perspective view of the putter head shown in FIG. 19.
Figure 20:
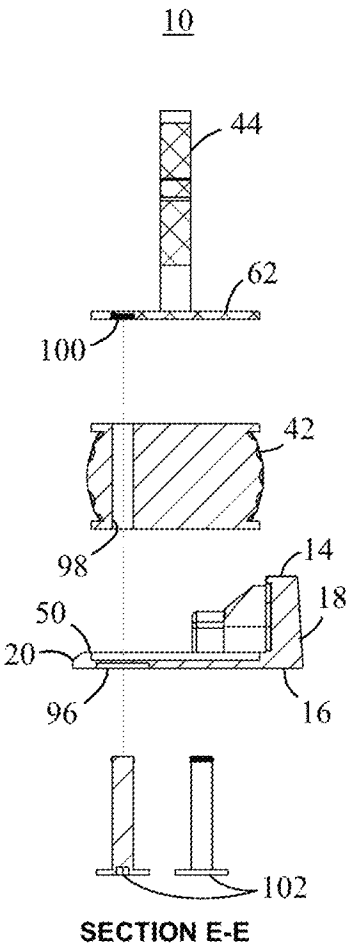
FIG. 20 is an exploded cross-sectional view, taken along line E-E, of the putter head shown in FIG. 19.
Figure 19:
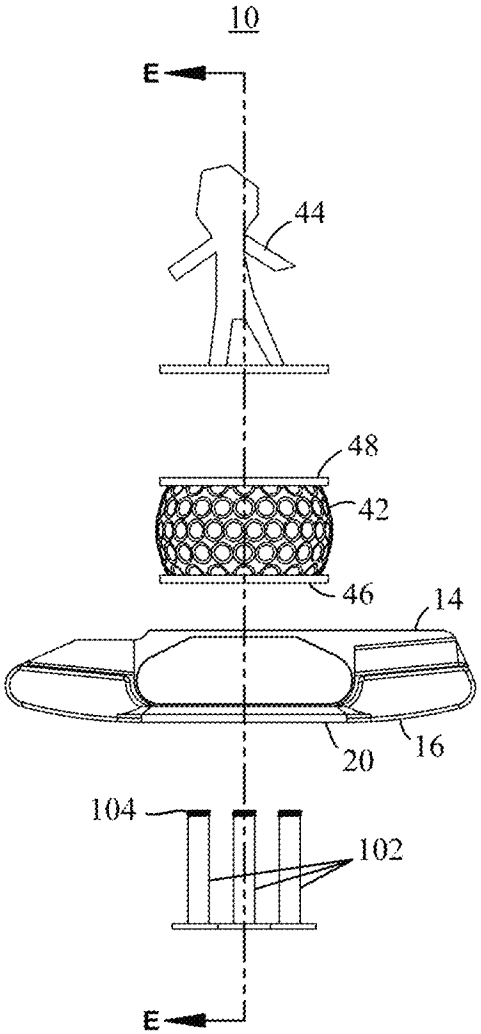
FIG. 19 is an exploded rear view of a putter head having a fifth embodiment of a removable attachment means for a weighted artifact according to the present invention.

FIGS. 19 through 21 are various view of a putter head 10 having an alternative embodiment of the removable attachment means 21. FIG. 19 is an exploded rear view; FIG. 20 is an exploded cross-sectional view, taken along lines E-E; and FIG. 21 is an exploded perspective view. In the embodiment of the putter head 10 illustrated among FIGS. 19-21, the removable attachment means 21 is designed as two or more removable screws. In the illustrated embodiment, there are three screws being utilized for the removable attachment means 21. Preferably, the platform 20 includes two or more apertures 96 defined through the platform 20 and arranged within the perimeter formed by the lip 50. Similarly, the base 42 includes two or more apertures 98 defined therethrough and arranged to be complementary to the apertures 96 defined through the platform 20. In embodiments, such as the one shown, where the ornament 44 is removable from the base 42, a similar number of threaded apertures 100 are formed in the bottom surface of the ornament base 62 and arranged to be complementary to apertures 96 and 98. A corresponding number of screws 102 are thereafter used to secure the weighted artifact 24 to the platform 20. The screws 102 have a length sufficient to reach the threaded apertures 100 in the ornament base 62 when the weighted artifact 24 is assembled onto the platform 20. When so engaged, the screws 102 are flush with the bottom surface 16 of the platform 20 so as to not impede or otherwise interfere with the player's putting stroke.

In some preferred embodiments, the screws 102 are specially designed for use with the putter head 10 and only have threads 104 at the terminal end to engage with the threaded apertures 100 formed in the ornament base 62. The apertures 96 and 98 defined through the platform 20 and base 42 are simply holes, with no threading present therein. In embodiments where the ornament 44 is integrated with the base 42, the apertures 98 formed in the base may extend less than fully through the base 42 and include the internal threads to engage the screws 102. The screws 102 used in such embodiments need only have a length sufficient to reach the internal threads formed in apertures 98 of the base 42. The screws 102 are preferably flush with the bottom surface 16 when so engaged.

The number of apertures 96, 98 and 100 defined in each of the platform 20, the base 42 and the ornament 44, respectively, correspond to one another so that if the platform 20 includes three apertures 96 (as shown), each of the base 42 and the ornament 44 include a corresponding three apertures 98 and 100. The apertures 96, 98, and 100 are arranged to be complementary to one another. In preferred embodiments utilizing three of each aperture 96, 98, 100, it is preferred that the apertures are radially separated by about 120-degrees around the perimeter of the platform 20, the bottom surface 46 and the ornament base 62. This provides the player the opportunity to rotate the weighted artifact 24 around the platform 20 relative to the impact face 18 in increments of 120-degrees. In other embodiments, there may be more or less than three apertures to provide for smaller or larger increments of rotation.

Figure 24:
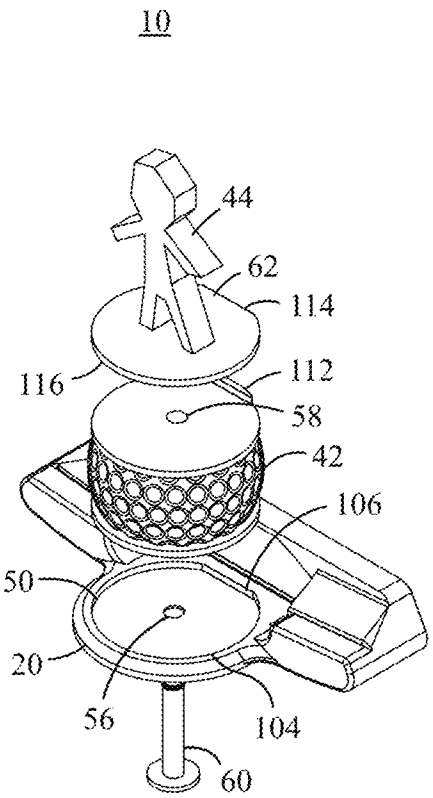
FIG. 24 is an exploded perspective view of the putter head shown in FIG. 22.
Figure 23:
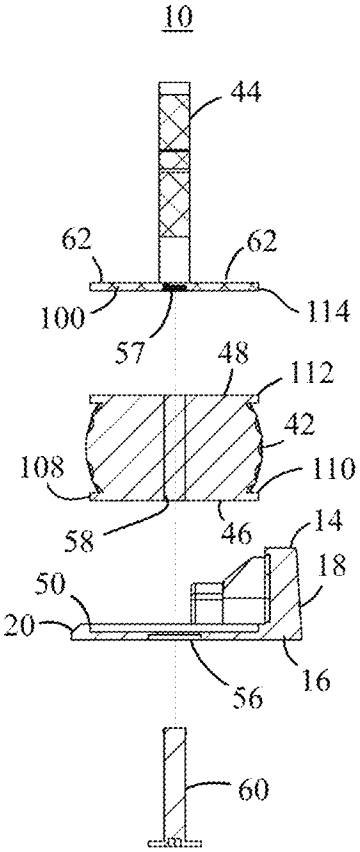
FIG. 23 is an exploded cross-sectional view, taken along line F-F, of the putter head shown in FIG. 22.
Figure 22:
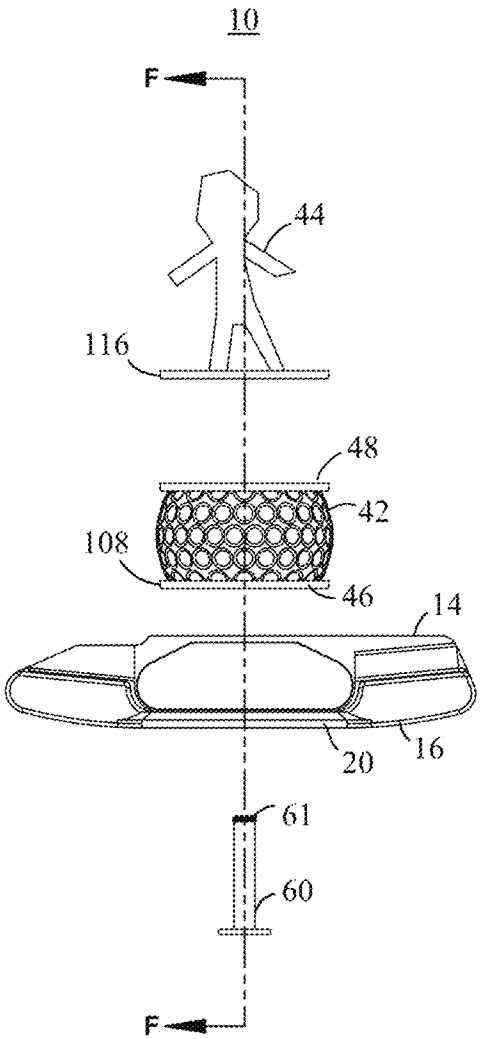
FIG. 22 is an exploded rear view of a putter head having a sixth embodiment of a removable attachment means for a weighted artifact according to the present invention.

In further embodiments of the putter head 10 according to the present invention, the removable attachment means 21 may prevent rotation of the weighted artifact 24 relative to the impact face 18. In such embodiments, the weighted artifact 24 may interface with the platform 20 in only one position and cannot be rotated thereabout. FIGS. 22 through 24 are various views of the putter head 10 having an embodiment of a non-rotatable removable attachment means 21. FIG. 22 is an exploded rear view; FIG. 23 is an exploded cross-sectional view, taken along lines F-F; and FIG. 24 is an exploded perspective view. The platform 20 forms a non-circular interface 104 that includes a notch 106 formed in the lip 50. The perimeter 108 of the bottom surface 46 of the base 42 is formed with a flat section 110 that is complementary to the notch 106 formed in the lip 50 of the platform 20. Thus, the base 42 fits to the platform 20 by aligning the flat section 110 with the notch 106. The base 42 is preferably friction-fit to the platform 20 upon alignment of the flat section 110 and the notch 106.

An optional screw 60, such as that described previously, may be used to further secure the base 42 to the platform 20. In such embodiments, similar to those previously described, there is an aperture 56 defined through the platform 20 and a complementary aperture 58 defined in the base 42. In some embodiments where the ornament 44 is removable from the base 42, there is a threaded aperture 57 formed in the ornament base 62. The threaded aperture 57 engages threads 61 of the screw 60 to secure the weighted artifact 24 to the platform 20. Alternatively where the ornament 44 is integral with the base 42, the aperture 58 may include internal threads to engage the screw 60. Preferably, the screw 60, when fully engaged, is flush with the bottom surface 16 of the platform 20.

In embodiments where the ornament 44 is removable from the base 42, the top surface 48 of the base 42 includes an edge protrusion 112 extending upward therefrom. The ornament base 62 includes a flat section 114 formed in the perimeter 116 thereof. The flat section 114 is complementary to the edge protrusion 112. With a proper alignment between the flat section 114 and the edge protrusion 112, the apertures 56, 58 align with the threaded aperture 57 to receive the screw 60 therethrough. Given that the proper alignment among the platform 20, the base 42 and the ornament 44 in this embodiment can only be achieved at one position, the weighted artifact 24 cannot be rotated around the platform 20 relative to the impact face 18. This embodiment gives a player the least amount of customization.

In the following discussion, various embodiments of the weighted artifact 24 are disclosed. Thus far, the weighted artifact 24 includes a base 42 and an ornament 44 that may or may not be removable from the base 42. In all previously described embodiments, the ornament 44 is illustrated as being removable from the base 42 but it should be understood that any of these previously disclosed embodiments, the base 42 and ornament 44 may be formed as a single piece. The weighted artifact 24 described in the following paragraphs may be used with any of the previously disclosed embodiments of the putter head 10 according to the present invention.

Figure 26:
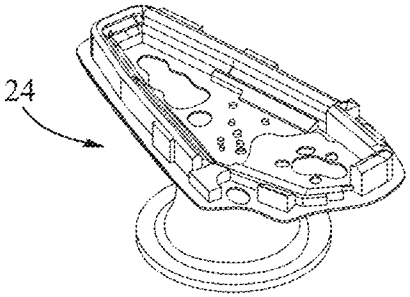
FIG. 26 is a perspective view of a further alternative embodiment of a weighted artifact according to the present invention.
Figure 27:
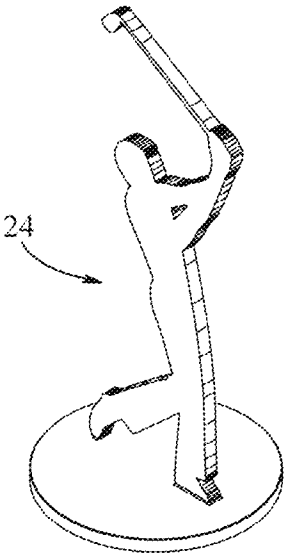
FIG. 27 is a perspective view of a further alternative embodiment of a weighted artifact according to the present invention.
Figure 25:
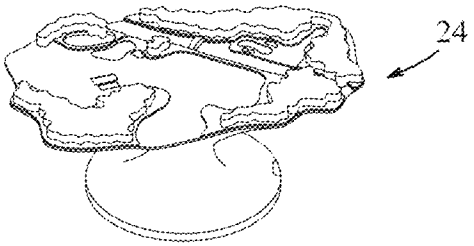
FIG. 25 is a perspective view of an alternative embodiment of a weighted artifact according to the present invention.

FIGS. 25 through 27 are various perspective views of alternative embodiments of the weighted artifact according to the present invention. The weighted artifact 24 shown among FIGS. 25-27 may be used with any of the previously described putter heads 10. In FIGS. 25 and 26, the weighted artifact 24 is formed as a model of a golf course hole, such as the famous 12th hole at Augusta National Golf Course (FIG. 25) or the 16th hole TPC Scottsdale (FIG. 26). FIG. 27 illustrates a weighted artifact 24 in the form of a golfer sculpture.

The weighted artifact 24 may be formed as a 2-D or 3-D model of a golf course hole or a sculpture. The golf course hole model may be of a famous hole from a famous golf course, such as those shown by FIGS. 25-26, or it may be any hole from any golf course. In embodiments where the weighted artifact 24 is in the form of a sculpture, the ornament may be formed as a comic book hero or villain, a middle finger, a mascot, or anything else desired by the player for customizing their putter head 10. The weighted artifact 24 may be symmetrical, so that rotation of the artifact with respect to the platform or impact face has no effect on the center of gravity of the putting head, or the weighted artifact 24 may be asymmetrical, so that a golfer may desirably alter the center of gravity of the putting head by rotating the artifact with respect to the platform or impact face.

In some embodiments where the weighted artifact 24 is formed of the base 42 and a removable ornament 44, the base 42 may also serve as an attachment platform for various putting training aids. For instance, the center aperture 58 defined through the base 42 in some embodiments of the weighted artifact 24 may serve to mount a training device, such as a laser. Alternatively, the entire weighted artifact 24 may be formed as a training device that attaches to the platform via the removable attachment means 21, e.g., a base 42 with an integrated laser for proper alignment training. In such embodiments, the training device, e.g., laser, that is integrated to the base 42 may be described as the ornament 44.

In any of the previously described weighted artifacts 24, there may be a symmetric or asymmetric weight distribution depending on a number of factors, including the choice of materials and design of artifact provided thereby. For instance, the base 42 may enclose a plurality of weights that are asymmetrically arranged within the base. This may provide one side of the base 42 with more weight than the other sides of the base so that when the weighted artifact 24 is attached to the platform 20, the player may customize the weight distribution by rotating the weighted artifact 24 to place the heavier side closer or farther away from the impact face 18. Alternatively, the base 42 may provide for a uniform weight distribution and the customization of the weight distribution for the putter head 10 comes from rotating a removable ornament 44 about the top surface 48 of the base. Depending on the style of the removable ornament 44, the ornament 44 itself may be asymmetrically weighted so that attachment of the ornament at any position relative to the impact face 18 alters the weight distribution of the putter head 10. In further alternative embodiments, such as those shown in FIGS. 25-26, the entire weighted artifact 24 may be asymmetrical and asymmetrically weighted as a byproduct of the design chosen.

As briefly discussed above, where the ornament 44 is removable from the base 42, it is preferred that the ornament 44 be attached to the top surface 48 of the base 42 in the same manner provided by the removable attachment means 21 for attaching the base to the platform 20. Thus, in embodiments where the base 42 attaches to the platform 20 via a plurality of complementary magnets, it is preferred that the ornament 44 attach to the base 42 via a plurality of complementary magnets. This uniformity in attachment mechanisms between the platform 20, base 42, and ornament 44 allows the player to further customize their putter head 10 without requiring any additional or alternative pieces. A player may opt for attaching the entire weighted artifact 24 (i.e., base 42 plus ornament 44), only the base 42, or only the ornament 44 to the platform 20. Further, the putter head 10 remains functional without the weighted artifact 24 attached thereto and thus offers a further level of customization to the player.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A putter head, comprising:

a body defining a top surface, a bottom surface, an impact face formed between the top surface and the bottom surface, and having a platform extending in a direction parallel to the bottom surface;

the platform comprising a lip extending around a perimeter of the platform to define a depth;

one or more bosses extending from the platform;

a means formed in the top surface for engaging a putter shaft;

a weighted artifact extending from the platform above the top surface and having a bottom surface with one or more dimples defined therein, the one or more dimples configured to engage the one or more bosses; and a means for removably attaching the weighted artifact to the platform.

2. The putter head of claim 1, wherein the platform is substantially circular.

3. The putter head of claim 1, further comprising at least one first aperture defined through the platform and at least one second aperture defined in the weighted artifact.

4. The putter head of claim 3, wherein the removable attachment means further comprises at least one screw extendable through the at least one first aperture and engageable to the at least one second aperture.

5. The putter head of claim 1, wherein the removable attachment means further comprises a plurality of magnets embedded in the platform and a plurality of complementary magnets embedded in a bottom surface of the weighted artifact to magnetically attach the weighted artifact to the platform.

6. The putter head of claim 5, wherein the removable attachment means further comprises a screw threadably engageable through complementary apertures defined through the platform and in the weighted artifact.

7. The putter head of claim 1, wherein the removable attachment means further comprises a bayonet connection.

8. The putter head of claim 7, wherein the bayonet connection comprises two or more slots defined in the lip, each slot forming a ledge in the lip.

9. The putter head of claim 8, wherein the weighted artifact further comprises two or more arms extending from a perimeter of a bottom surface of the weighted artifact, the two or more arms arranged to be complementary to the two or more slots.

10. The putter head of claim 1, wherein the weighted artifact comprises a base and an ornament.

11. The putter head of claim 10, wherein the base further comprises a means for removably and rotatably attaching the ornament to the base.

12. The putter head of claim 11, wherein the removable attachment means and the removably and rotatably attaching means have an identical configuration.

13. The putter head of claim 1, wherein the weighted artifact comprises an asymmetrical sculpture or model.

14. A putter head, comprising:

a body defining a top surface, a bottom surface, an impact face formed between the top surface and the bottom surface, and a platform extending perpendicular to the impact face;

a plurality of dimples defined in the platform;

a means formed in the top surface for engaging a putter shaft;

a weighted artifact extending from the platform above the top surface, the weighted artifact comprising a base having a bottom surface and top surface, and an ornament removably and rotatably coupled to the top surface of the base, the bottom surface of the base having a plurality of bosses complementary to the plurality of dimples; and a means for removably attaching the base to the platform.

15. The putter head of claim 14, wherein the bottom surface of the base has a configuration complementary to the platform.

16. The putter head of claim 14, wherein the removable attachment means further comprises a plurality of complementary magnets embedded in the platform and in the bottom surface of the base, the plurality of complementary magnets symmetrically arranged to allow the base to be rotated around the platform relative to the impact face.

17. A putter head, comprising:

a body defining a top surface, a bottom surface, an impact face formed between the top surface and the bottom surface, and a platform extending in a direction perpendicular to the impact face in a horizontal plane;

one or more bosses extending from the platform;

a means formed in the top surface for engaging a putter shaft;

a weighted artifact extending from the platform above the top surface, the weighted artifact having a bottom surface with one or more dimples defined therein, the one or more dimples configured to engage the one or more bosses; and a means for removably attaching the weighted artifact to the platform.

18. The putter head of claim 17, further comprising a means for rotating the weighted artifact about an axis of rotation to cause a change to a center gravity of the putter head relative to the impact face simultaneously along two orthogonal axes that are parallel to the horizontal plane and that are normal to the axis of rotation.

* * * * *